US005704309A

United States Patent [19]

Kohnen

[11] Patent Number: 5,704,309

[45] Date of Patent: Jan. 6, 1998

[54] HYBRID BOAT AND UNDERWATER WATERCRAFT

[75] Inventor: William Kohnen, Claremont, Calif.

[73] Assignee: SEAmagine Hydrospace Corporation, Claremont, Calif.

[21] Appl. No.: 568,270

[22] Filed: Dec. 6, 1995

[51] Int. Cl.[6] ..... B63G 8/00

[52] U.S. Cl. ..... 114/312; 114/333; 114/337; 114/123; 114/125

[58] Field of Search ..... 114/312, 313, 114/321, 322, 326, 330, 331, 332, 333, 334, 337, 338, 121, 123, 124, 125, 183 R, 274

[56] References Cited

U.S. PATENT DOCUMENTS

| | | | |
|---|---|---|---|
| 3,131,664 | 5/1964 | McInvale | 114/333 |
| 3,492,962 | 2/1970 | Brainard | 114/333 |
| 3,683,835 | 8/1972 | Deslierres | 114/16.4 |
| 3,807,341 | 4/1974 | Miller | 114/331 |
| 3,896,628 | 7/1975 | Hansen | 61/46.5 |
| 4,153,001 | 5/1979 | Krasberg | 114/312 |
| 4,350,111 | 9/1982 | Boyce, II | 114/245 |
| 4,455,962 | 6/1984 | Gongwer | 114/331 |
| 4,577,583 | 3/1986 | Green, II | 114/332 |
| 4,721,055 | 1/1988 | Pado | 114/331 |
| 4,938,164 | 7/1990 | Onofri | 114/312 |
| 5,129,348 | 7/1992 | Rannenberg et al. | 114/333 |
| 5,248,978 | 9/1993 | Manthy et al. | 342/54 |
| 5,303,666 | 4/1994 | Desantis et al. | 114/315 |
| 5,379,267 | 1/1995 | Sparks et al. | 367/18 |
| 5,379,714 | 1/1995 | Lewis et al. | 114/315 |

OTHER PUBLICATIONS

*Diver*, Mar. 1988, cover page "The Little Urchin, New Sub From British Columbia".

"Touring The Deep", by Gregory T. Pope (Feb., 1993).

Brochure, "Neyk Submarine" (date not known).

Brochure, "Nomad 1000", International Venture Corp. (date not known).

Brochure, "Atlantis Submarines" (date not known).

Brochure, "ResortSub", International Venturecraft Corp. (date not known).

*Popular Mechanics*, Apr. 1993, Tech Update, News of Tomorrow's Technology Today, "Personal Viewmobile Of The Deep," p. 13.

*Discover*, Sep. 1992, Technology Watch, "Fly Like a Cetacean" by Glen Martin.

*Popular Mechanics*, Oct. 1988, cover page "New Family Sightseeing Subs, Experience The Ocean's Wonders As Never Before".

Brochure, "Johnson–Sea–Link I & II", Harbor Branch Oceanographic Institution (date not known).

Brochure, "Clelia PC 1204", Harbor Branch Oceanographic Institution (date not known).

Brochure, "Deep Rover", Deep Ocean Engineering (date not known).

Brochure, "Phantom DHD2", Deep Ocean Engineering (date not known).

Brochure, "Phantom Ultimate", Deep Ocean Engineering (date not known).

Undate Picture Showing "Avalon Aquatics", Sea Urchin (date not known).

*Primary Examiner*—Stephen Avila

*Attorney, Agent, or Firm*—Baker & McKenzie

[57] ABSTRACT

A hybrid boat and underwater craft and method for operating an underwater craft having positive buoyancy, a three-point stabilization system and vertical thruster and a system for enhanced buoyancy at the surface.

27 Claims, 5 Drawing Sheets

HYBRID BOAT AND UNDERWATER WATERCRAFT

BACKGROUND OF THE INVENTION

The present invention relates to a hybrid boat and underwater watercraft for recreational touring both under and on the surface of a body of water.

Various forms of underwater craft are known. The known craft utilize various forms of ballast techniques and apparatus in order to adjust buoyancy, various forms of propulsion, and various forms of stabilization systems. Such underwater craft are described, for example, in U.S. Pat. Nos. 4,577,583, 4,721,055 and 4,938,164.

Some known underwater craft have a positive buoyancy when submerged. These positive buoyancy craft rely upon various means to submerge, such as wing-like structures or anchored tethers. In craft having the wing-like structures, the wing-like structures are used to create a downward force when the craft is moving forward. Such craft typically can not hover in place, as they tend to rise when not moving. In tethered craft, the tether provides a guide on which the craft moves. The tether is linked at one end to the watercraft and at the other end to a weight or other structure which prevents it from floating upwards. This watercraft suffers the disadvantage that the tether restricts movement, not only in the upward and downward direction, but also in horizontal translation, as the watercraft is restricted to the length of its tether.

Other types of known positively buoyant watercraft rely on a multitude of vertical thrusters in order to provide the downward force needed to submerge and to provide stabilization. Some such watercraft are designed to have a positive buoyancy which is countered by the action of the vertical thrusters. These watercraft suffer the disadvantage that stabilization typically involves a complicated balancing of buoyancy elements and the forces generated by the thrusters.

Other craft rely on ballasting systems for controlling depth. In such systems, the depth of the craft can be controlled by selectively flooding the ballast chamber or chambers with water or air, depending on the depth desired.

Still other types of underwater craft are generally non-buoyant, and rely on various systems to create lift, and thereby float to the surface when desired. Some such watercraft rely on vertical thrusters which exert a lifting force. Others, rely on ballasting systems. Such non-buoyant watercraft suffer the disadvantage that if there buoyancy-providing system fails, the watercraft will tend to sink to the bottom, rather than float to the surface. This occurs because the weight of the watercraft is greater than the buoyant force created by the volume of the watercraft.

In addition to the disadvantages of the known underwater craft discussed above, each also provides only a small amount of buoyancy for floating on the surface, which limits the amount of the vessel that can rise above the surface. The size of known ballast tanks required to generate the buoyancy required to allow the known vessels to emerge from the water typically would create an unacceptable amount of drag underwater, as well as increase the size of the vessel. Providing such proportionally large internal ballast tanks results in a correspondingly large increase in the volume and therefore drag of the watercraft. In order to counter the increased drag and volume, the size and power of the watercraft propulsion system must proportionately be increased.

SUMMARY OF THE INVENTION

The present invention alleviates to a great extent the disadvantages of the known underwater craft by providing a hybrid boat and underwater craft which provides stabilization control in a positively buoyant watercraft using a vertical thrust system in order to provide depth control, a buoyancy adjusting system, and a surface-buoyancy supplementing system.

Any form of vertical thrust system may be provided, as long as a sufficient downward thrust can be generated in order to counteract the buoyancy of the vessel, thereby enabling the vessel to submerge. In order to submerge, a downward thrust exceeding the buoyancy of the vessel is provided by the thruster system. In order to raise the vessel, such as from a submerged position to a surfaced position, the downward thrust is reduced to a level that is insufficient to counter the positive buoyancy of the vessel. An advantage of this system is that in the event of a thruster failure, the vessel may simply rise to the surface because of its buoyancy. Preferably a single point thruster system is used in order to actively counter the positive buoyancy of the watercraft.

A three point stabilization system is provided in order to provide fore to aft stabilization of the vessel. Using that system, buoyancy is provided at the fore and aft of the vessel, such as by a generally air-filled sealed front buoyancy chamber and by a buoyant tail section of the vessel. Additional buoyancy may be provided using other chambers, as discussed below. The buoyancy provided by the buoyancy chambers preferably exceeds the downward force provided by the weight of the vessel. Optionally, the buoyancy provided exceeds the downward force provided by the weight of the vessel as well as any passengers or cargo. The thruster preferably is situated near the center of gravity.

In addition, the surface-buoyancy supplementing system preferably includes a cut-out portion in the upper surface of the vessel and optional soft tanks. Preferably, at least two soft tanks are provided, one on each of the left and right sides of the vessel. The soft tanks can also be situated at any position on the vessel.

Surface buoyancy is supplemented by a cut-out section, or boat section of the upper portion of the vessel. This provides a boat volume, which may be free flooded when submerged, but which is drained when on the surface—providing boat-like buoyancy. The added buoyancy provided by the boat section enables and an increased volume of the watercraft to protrude above the surface of the water. This offers the advantages of increase surface buoyancy, with no added buoyancy when submerged. In addition, surface stability of the vessel is enhanced. Furthermore, the increased surface buoyancy is provided without resorting to costly ballast tanks, which also increase the size and drag of the vessel.

The buoyancy adjusting system can include buoyancy adjusting chambers in any fashion which will allow the buoyancy to be adjusted. Likewise, it is preferred that they be arranged to enhance the stability of the vessel. Water is evacuated from the chambers when buoyancy is increased. Alternatively, the buoyancy adjusting system may include fixed buoyancy elements, such as in the tail section or front of the watercraft, with buoyancy adjustment achieved using counterweights. In this embodiment, the buoyancy adjusting chambers are not required.

Each of the above-described features of the present invention can be combined with each other in any fashion, including combining each of the features together in a single watercraft.

BRIEF DESCRIPTION OF THE DRAWINGS

The above and other objects and advantages of the invention will be apparent upon consideration of the following detailed description, taken in conjunction with the accompanying drawings in which like reference characters refer to like parts throughout and in which.

DETAILED DESCRIPTION OF THE INVENTION

Figure 1:
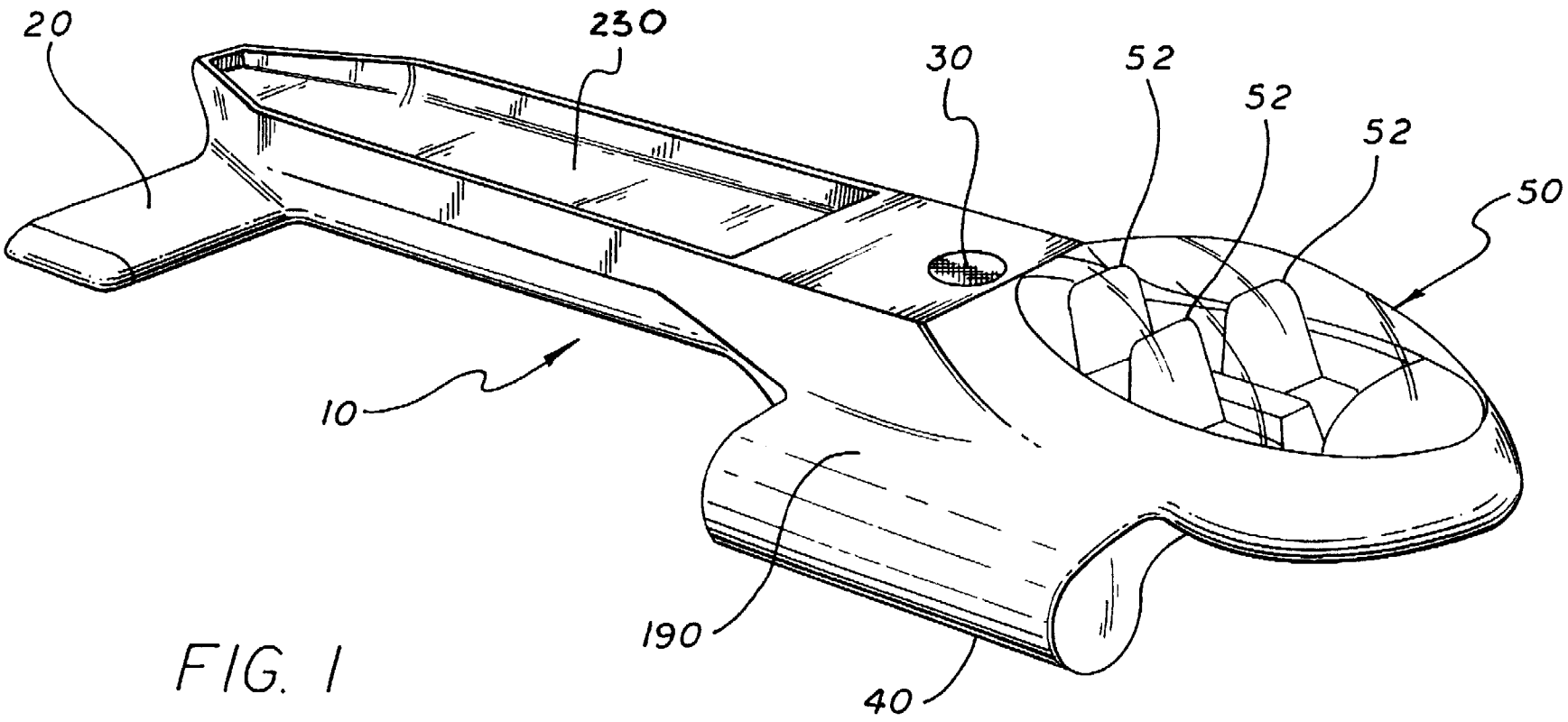
FIG. 1 is a front view of a watercraft in accordance with the present invention.

FIG. 1 provides a perspective view of a hybrid boat/underwater craft in accordance with the present invention. Any shape or size of watercraft may be used. The watercraft includes a structure 10 for supporting the various components, including a tail section 20, vertical thruster system 30, a buoyancy control system, including supplemental buoyancy chambers 40 and a front buoyancy chamber 50.

The watercraft has a positive buoyancy when in use. This means that in the absence of a mechanically provided downward thrust, the watercraft floats to the surface. The buoyancy is provided by a buoyancy control system comprising a plurality of buoyancy providing elements. A downward thrust is provided in order to submerge the watercraft using the vertical thruster system 30.

In the preferred embodiment, a generally three-point stabilization system is achieved using the buoyancy control system in conjunction with a center of gravity 60 of the watercraft. The vertical thruster system 30 works in conjunction with the three point stabilization system in order to submerge the watercraft when desired in a stable fashion.

The location of the center of gravity 60 of the watercraft depends on the location of and weights of the various components of the watercraft. In the embodiment depicted in FIG. 2, the center of gravity 60 is situated near the bottom and rear section of the front buoyancy chamber 50. A downward force is illustrated by a downward pointing arrow 70, showing a downward force on the watercraft associated with the weight, applied at the center of gravity 60.

Figure 2:
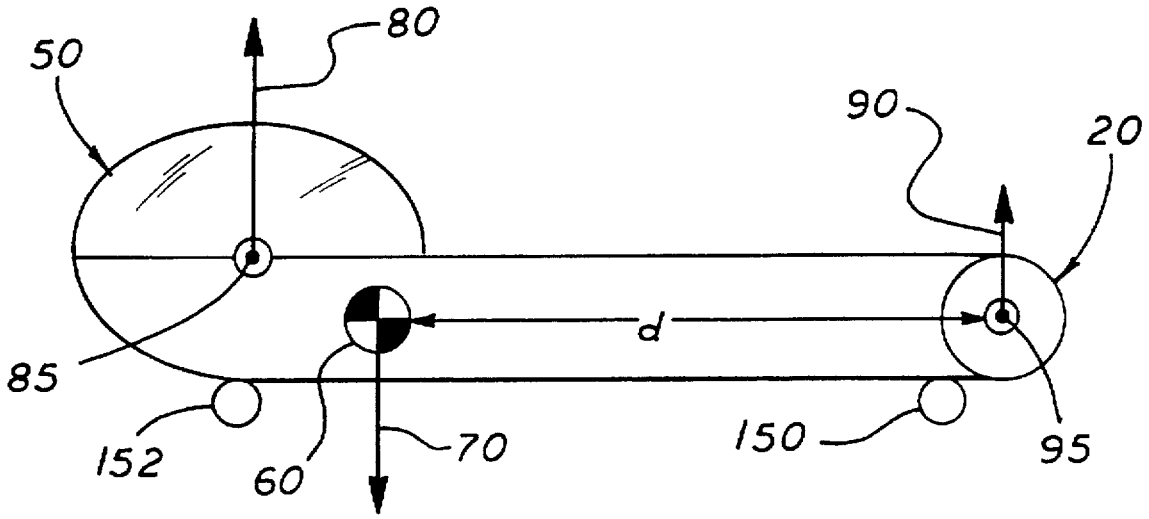
FIG. 2 is a side view of a watercraft in accordance with the present invention.
Figure 3:
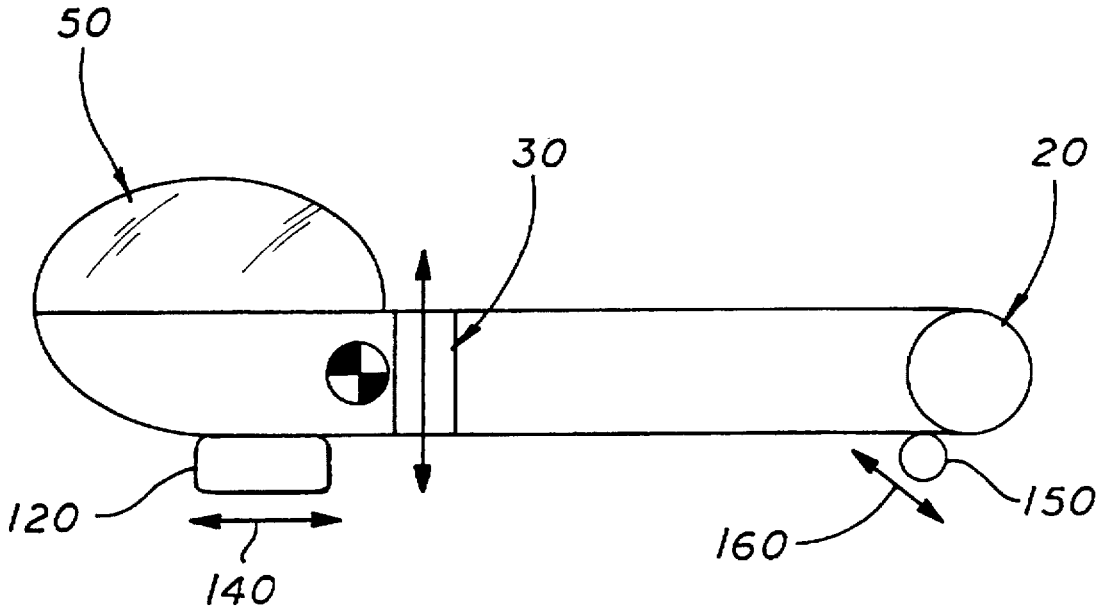
FIG. 3 is a side view of a watercraft in accordance with the present invention.

The downward force 70 attributable to the weight of the watercraft, and illustrated at the center of gravity 60, is counteracted by upward forces (i.e. buoyant forces) from the tail section 20 and front buoyancy chamber 50. Arrows depicting these buoyancy forces 80, 90 are illustrated in FIG. 2. The buoyant forces will vary depending whether the watercraft is completely submerged or only partially submerged. For example, in one embodiment, when the watercraft is floating on the surface of water, a portion of the front buoyancy chamber 50 is situated above the surface. In such a floatation state, the buoyancy of the emerged portions (i.e. above the surface) is reduced generally in proportion to the amount of its volume which is above the surface. In one embodiment, the buoyancy of the watercraft at the surface (or below the surface if desired) may be supplemented using the supplemental buoyancy apparatus discussed below. The depiction in FIG. 2 corresponds to a fully submerged state in which the watercraft, including the front buoyancy chamber 50 is completely submerged.

In the completely submerged state, it is preferred that the downward forces from the watercraft weight 70 be exceeded by the buoyant forces 80, 90 from the front buoyancy chamber 50 and tail section 20. In this embodiment, the watercraft will float to the surface in the absence of a counteracting downward force, such as may be generated by the vertical thruster system 30. In use, the watercraft may carry cargo, passengers and/or equipment (collectively referred to as "cargo"), any of which will effectively add weight to the watercraft. In one embodiment, the weight of the watercraft, including cargo may be fully counteracted by the buoyant forces 80, 90 of the front buoyancy chamber 50 and tail section 20.

Alternatively, a buoyancy adjusting apparatus may be used in order to adjust the buoyancy of the watercraft. The amount of buoyancy can be adjusted to a desired level using a supplemental buoyancy apparatus, such as depending on the weight of the cargo. For example, if heavy equipment or passengers are carried, a greater amount of supplemental buoyancy may be desired than when light equipment or passengers are carried. The buoyancy adjusting apparatus is discussed in more detail below.

Another buoyancy adjusting apparatus may use fixed buoyancy elements and/or counterweights. For example, counterweights 108 may be applied to the watercraft, such as at the front end. Preferably, such front end counterweights are applied in line with the center of the weight of the passengers or any cargo and provide a sufficient amount of weight so as to give the watercraft the same weight, regardless of the weight of the passengers or cargo. For example with light cargo, heavier weights would be applied, whereas with heavy cargo, lighter weights would be applied. As an alternative, movable counterweights 105 may be used. For example, a counterweight at the tail may be moved fore or aft so as to adjust the moment created by any buoyancy elements in the tail. The use of variable buoyancy devices may be eliminated from the supplemental buoyancy system in this embodiment.

In the three point stabilization system illustrated in FIG. 2, the front buoyancy chamber 50 provides a large fixed buoyancy force 80 upwards at the center of buoyancy 85 of the front buoyancy chamber. This center of buoyancy 85 is slightly forwards from the center of gravity 60. The weight of the watercraft imparts a downward force 70, which may be viewed as being imparted at the center of gravity 60.

In one embodiment, the upward force 80 from the front buoyancy chamber 50 will exceed the weight of the watercraft 70. Unless the center of gravity 60 is at the same point as the center of the upward force from the front buoyancy chamber 50, the watercraft will tend to rotate (i.e. pitch) without stabilization. In one embodiment, the axis of rotation will tend to be at a point between the center of gravity 60 and center of the upward force form the front buoyancy chamber 50. Additional lift is provided by the tail section 20. This additional lift 90 counteracts the tendency to rotate. The tail force 90 is effectively applied at the center of buoyancy 95 of the tail section 20.

In an alternative embodiment, the upward force 80 from the front buoyancy chamber 50 will exceed the weight of the watercraft 70. Unless the center of gravity 60 is at the same point as the center of the upward force from the front buoyancy chamber 50, the watercraft will tend to rotate without stabilization, in the opposite direction from the tendency to rotate described in the embodiment above. The additional buoyancy 90 provided by the tail section 20 counteracts the tendency to rotate.

In the preferred embodiment, illustrated in FIG. 2, the center of gravity 60 is close to the front end of the watercraft. The moment arm "d" for the buoyant force 90 of the tail section is much longer than for the front buoyant chamber force 80. Because of that, a tail buoyant force 90 required to offset the tendency to rotate is smaller than that of the front buoyant force 80. Also in a preferred embodiment, the buoyant forces 80, 90 applied at the front end and/or tail section 20 of the watercraft may be varied. By varying the buoyant forces 80 or 90, there is compensation for the varying weight of the watercraft 70, such as due to varying cargo weights. The buoyant forces 80 and 90 may be varied such as by varying the buoyancy generated by the pertinent buoyancy elements. Alternatively, the buoyant forces may be varied such as by adding or removing weight, such as by using counterweights 105, 108 or by using movable counterweights 105.

In still another embodiment, cargo, passengers or equipment (collectively referred to as "cargo") are loaded into or adjacent the front buoyancy chamber 50. In addition, removable or movable counterweights may be provided. The weight of the watercraft plus cargo (plus counterweights) may exceed the buoyant forces 80, 90 provided by the front buoyancy chamber 50 and tail section 20. In this embodiment, additional buoyancy is provided by the supplemental buoyancy system, as described below. Alternatively, the relative buoyancy may be adjusted by removing counterweights, or by moving counterweights so as to reduce the moment created by the counterweights. The supplemental buoyancy provided (or weight removed) preferably is great enough so that the total buoyancy of the watercraft when submerged exceeds that weight of the watercraft and cargo.

Any generally water impermeable structure may be used for the front buoyancy chamber 50. Preferably, the front buoyancy chamber 50 includes a structure which is filled with air or other gaseous fluid, which has a lower density than water. In one embodiment, the chamber 50 may include a cockpit for providing a suitable atmosphere for humans, although in other embodiments, the watercraft is operated without human occupants. In the cockpit embodiment, seating structures 52 also may be provided.

The size of the chamber 50 depends on the use desired. In general, the greater the amount of buoyancy desired, the greater the volume of chamber 50 required. Alternatively, the buoyancy of the chamber 50 may be adjusted by adjusting the thickness of the surfaces of the chamber 50, as measured from the outer surface 53 to the corresponding inner surface 55. Likewise the buoyancy of the chamber may be adjusted by using heavier or lighter materials. For example, a chamber 50 constructed of plastic or other polymeric material generally will provide greater buoyancy than a chamber 50 having the same volume and thickness, but constructed of a denser material, such as steel. In a preferred embodiment a clear plastic material is used.

Any shape of chamber 50 may also be used, such as a sphere, a tube with rounded ends, or an oblong tube as depicted in FIG. 1.

The tail section 20 is spatially separated from the front buoyancy chamber 50, in the aft portion of the watercraft. Any shape or size of tail section 20 may be used. The tail section 20 may be of solid construction, having a tail shell 100 enclosing with a material having a density less than water, thereby providing buoyancy. For example, any low density filler material may be used, such as foam materials (such as foamed rubber) or plastic.

Preferably, the tail section includes a movable counterweight system 105. In this system, counterweights are provided on the tail section 20. The counterweights are movable fore and aft so as to decrease and increase (respectively) the moment created by the weights. For example, by moving the counterweights aft, the moment created is increased, effectively decreasing the buoyancy of the tail section 20. The counterweights may be moved by any means, including electronic actuators or controls, mechanical control and actuation or manually. The counterweight system may be on the exterior of the tail shell 100 or in its interior.

Figure 11:
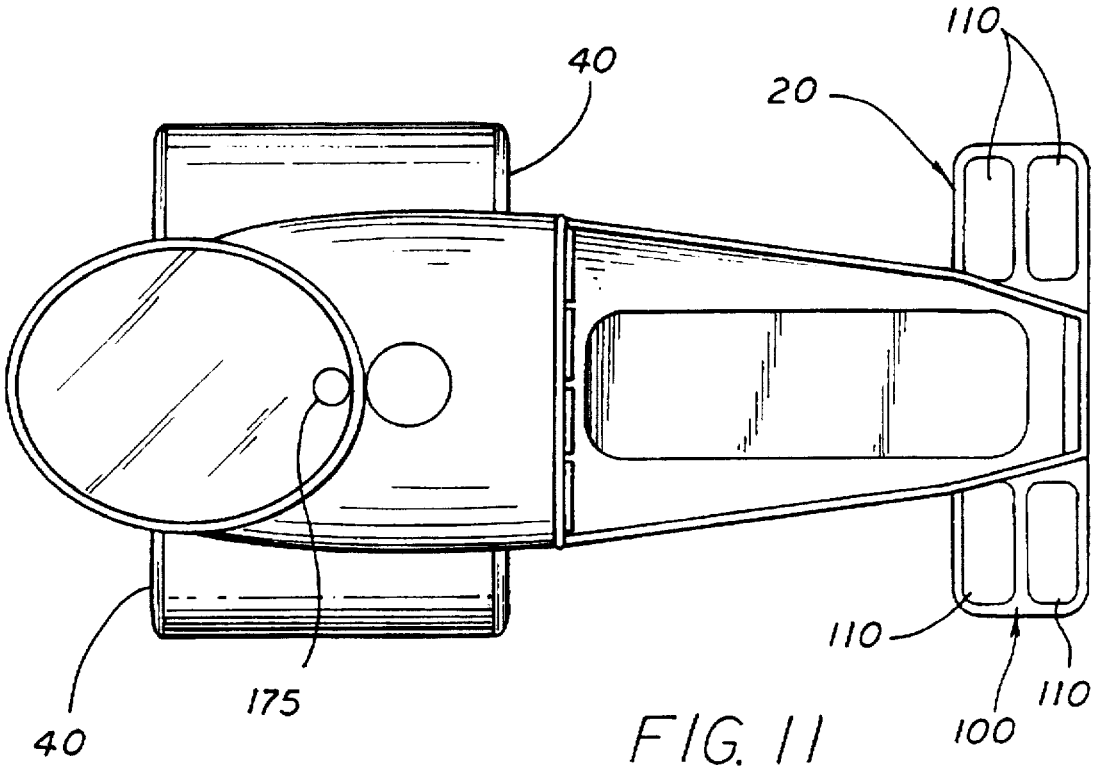
FIG. 11 is a top view of a watercraft in accordance with the present invention.
Figure 12:
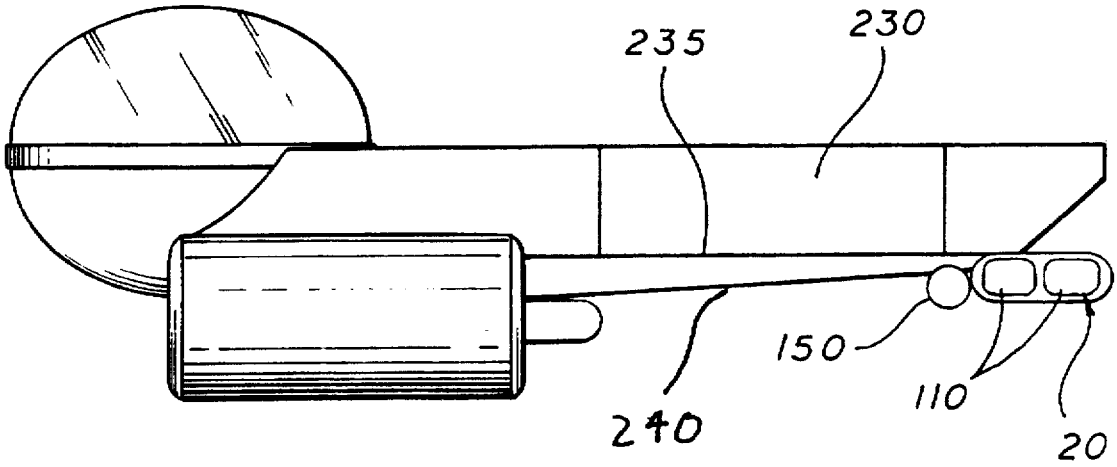
FIG. 12 is a side view of a watercraft in accordance with the present invention.

Alternatively, the tail section 20 may include one or more buoyancy chambers 110, within the tail shell 100. The chambers 110 can be partially or completely filled with a gaseous fluid, depending on the amount of buoyancy desired. The chambers also may be filled with a low density filler material, as described above. Likewise, the tail section 20 may take any shape. For example, in the tail section 20 depicted in FIGS. 2, 3 and 6–9is tubular in shape. The tail section 20 depicted in FIGS. 11–12 is shaped like a horizontal fin, or canard.

The vertical thruster system 30 is preferably mounted to the aft of the center of the front buoyancy force 80 and between the front buoyancy chamber 50 and the tail section 20. The action of the vertical thruster system 30 pushes the watercraft underwater. Preferably, the force center of the force generated by the vertical thruster system 30 is situated as close to the center of gravity 60 of the watercraft as is possible. This enables a minimization in a moment arm created between the vertical thruster system 30 and center of gravity 60. It also enables a minimization of the length of the moment arm "d" for the tail section 20, since the rotational force resulting from operation of the vertical thruster 30 to create a downward force is countered by the counter-rotational buoyant force from the tail section 20. In the embodiment depicted in FIG. 2, he vertical thruster system 30 is situated to the aft of the center of gravity 60. In an alternative embodiment, the center of gravity 60 is to the rear of the vertical thruster system 30. In another embodiment, the vertical thruster system 30 is at the center of gravity 60.

Any type of thruster, or combination of thrusters, may be used which is capable of generating a sufficient force to counteract the buoyancy of the watercraft. For example, a single vertical thruster may be used. Alternatively, multiple thrusters may be used and positioned so as to generate in combination a sufficient force to counteract the buoyancy of the watercraft. The thrusters used may be oriented so as to generate a force solely in the vertical direction. Alternatively, thrusters may be used which generate forces in various directions, such as at an angle to the vertical direction, as long as a vertical component of thrust is generated by the thruster or combination of thrusters.

In operation, the vertical thruster system 30 pushes the watercraft downward, in order to submerge it. An optional depth controller may be used which monitors the depth of the watercraft and places a limit on the maximum depth allowed. For example, the watercraft may be limited to a maximum depth of 100 feet below the surface. When the maximum depth is achieved, the vertical thruster system 30 is controlled so as to prevent the watercraft from submerging any further. For hovering at a particular depth, the vertical thruster system 30 may be controlled so as to provide a downward force essentially matching the upwards buoyancy of the watercraft, thereby achieving a force equilibrium. For rising the watercraft from a greater depth to a lesser depth, the vertical thruster system 30 may be controlled in various ways. For example, it may be turned off so as to allow the watercraft to rise due to its positive buoyancy. Alternatively, the thruster system 30 may impart a downward force, which is less than the upwards buoyant force, enabling the watercraft to rise in a controlled fashion slower than it would without operation of the vertical thruster system 30 at all. Still alternatively, the vertical thruster system 30 may impart an upwards force, enabling the watercraft to rise more rapidly than it would without such assistance. Preferably at about half down thrust of the vertical thruster system 30, the watercraft is neutrally buoyant, i.e. it will neither rise nor submerge.

Additional thruster systems may also be provided in order to provide linear or rotational movement of the watercraft, such as forward/backward, side-to-side and turning left/right. A forward/backward thruster system 120 may be provided so as to provide forward and rearward thrusts (which are illustrated diagrammatically as arrows 140 in FIG. 3). The thruster system 120 is controlled depending on the speed and direction desired. Likewise, multiple spatially separated thrusters may be used in the forward/backward thruster system 120 so as to enable side-to-side motion. Preferably, the thruster system 120 applies a forward/backward thrust 140 along the center line of the watercraft, which runs longitudinally from the rear to the front of the watercraft.

A tail thruster system 150 is provided to pivot the watercraft. The thrusts provided by the tail thruster system are indicated by arrows 160 in FIG. 2. The tail thruster system 150 is controlled depending on the direction desired. For example, if it is desired to move the watercraft to the left, the tail thruster system 150 is operated to swing the tail to the right. By moving the tail to the right, the orientation of the front end of the watercraft will be moved leftwards, thereby causing the watercraft to move left when the forward/reverse thruster system 120 is operated to provide a forward thrust. Preferably a single thruster may be used in the tail thruster system 150, although multiple thrusters may also be used.

A front thruster system 152 may also be provided towards the front end of the watercraft, so as to enable left/right motion, as described above. The front thruster system 152 may be operated in conjunction with the tail thruster system 150 so as to effect side-to-side motion. In this embodiment, the thrusters 150 and 152 are operated simultaneously, so as to cause side-to-side motion.

In an alternative embodiment, the buoyancy of the watercraft may be supplemented by using one or more supplemental buoyancy chambers 170. These supplemental buoyancy chambers 170 preferably are situated within the structure 10 of the watercraft, but alternatively may be placed at additional locations. Preferably, the supplemental buoyancy chambers 170 are not utilized. In the alternative embodiment, they are used to supplement the buoyancy of the watercraft in order to maintain a positive buoyancy in use. For example if the combined weight of the watercraft and cargo (plus counterweights, if any) exceeds the upward buoyancy provided by the front buoyancy chamber 50 and tail section 20, it may be desired to supplement the buoyancy using the supplemental buoyancy chambers 170. These chambers 170 may be used to supplement buoyancy in various ways. For example, if a fully buoyant effect is desired, the chambers may be filled with air or other gaseous fluid. Any air providing apparatus may be used to supply air to the chambers 170, such as pumps, tubes, air supply tanks, surface air tubes or human blowing. If a partial buoyant effect is desired, the chambers 170 may be partially filled with water. If no buoyant effect is desired, the chambers 170 may be completely filled with water. Likewise, the chambers 170 may be completely or partially filled with a buoyant solid material such as foamed plastic or rubber.

Preferably the supplemental buoyancy chambers 170 are hard tanks which can withstand pressure. Such hard tanks can be left empty, partially filled, or completely filled depending upon the buoyancy desired. Preferably, the hard tanks 170 are filled with water to a level that would bring the watercraft to a desired level of positive buoyancy, such as 50 lbs. The amount of buoyancy provided by the hard tanks 170 required to maintain the desired level of positive buoyancy (such as 50 lbs.) is varied depending upon the weight of cargo or passengers carried by the watercraft. For example, if a light load is carried by the watercraft, less buoyancy is required from the hard tanks 170.

In another embodiment, buoyancy may be adjusted using counterweights and/or movable counterweights 105, 108 as described in more detail above.

Buoyancy of the watercraft also can be supplemented using a surface-buoyancy supplementing system. In the surface buoyancy supplementing system, buoyancy chambers 40 are used. When additional buoyancy is desired, the chambers 40 are flushed of water. Any means for flushing 175 may be used, such as by using a mechanical pump, manual pump or blow tubes. By flushing the chambers 40, the buoyancy of the watercraft is effectively increased. When less buoyancy is desired, the chambers 40 are allowed to fill with water. The chambers 40 may be used to provide buoyancy, preferably when the watercraft is on the surface of the water. Preferably, when submerged, water is allowed to flow into chambers 40, creating a neutral buoyancy.

In the preferred embodiment, the chambers 40 are "soft" tanks. Such tanks generally are not intended or suited to withstand pressure. When submerged, the soft tanks 40 are flooded with water. On the surface, they are evacuated.

Any number of chambers 40 or soft tanks may be used. In one embodiment, a single chamber 40 is used. In the embodiment illustrated in the figures, two chambers 40 are used. In an alternative embodiment, no chambers 40 are used in the watercraft.

Figure 4:
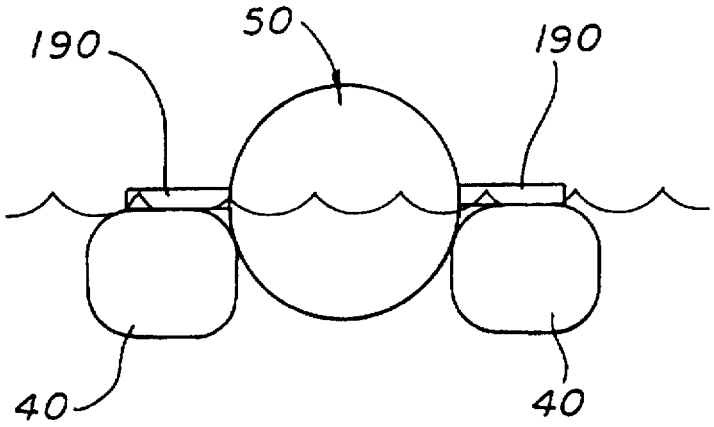
FIG. 4 is a front view of a watercraft in accordance with the present invention.
Figure 5:
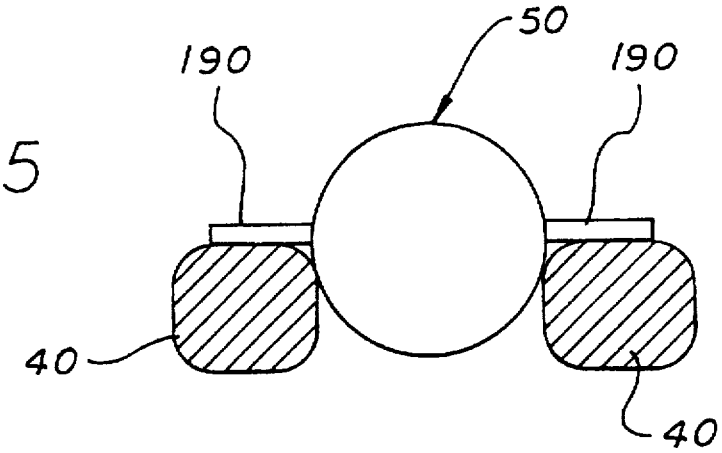
FIG. 5 is a front view of a watercraft in accordance with the present invention.
Figure 6:
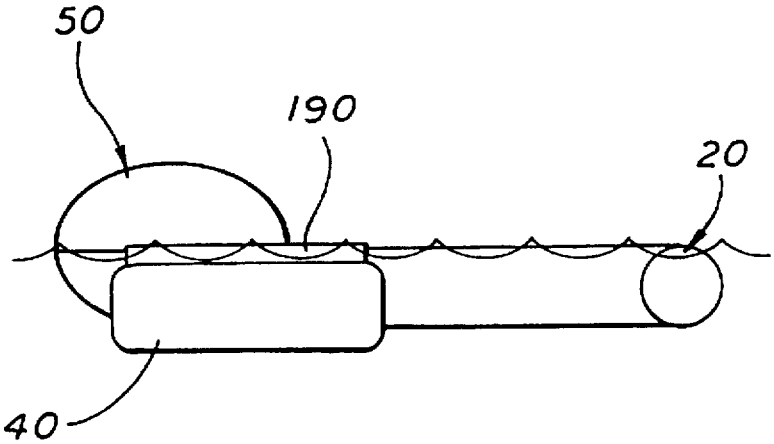
FIG. 6 is a side view of a watercraft in accordance with the present invention.
Figure 7:
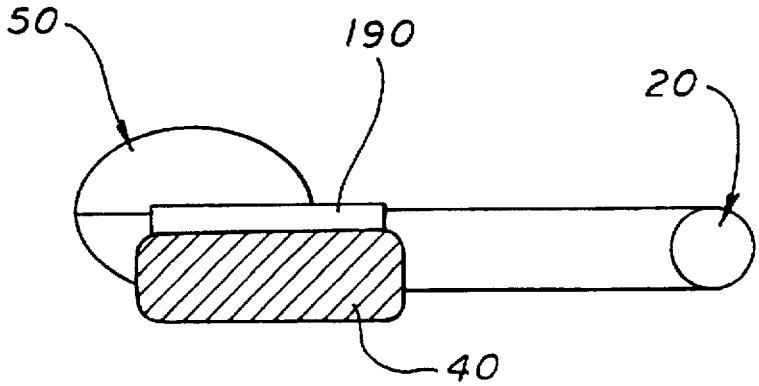
FIG. 7 is a side view of a watercraft in accordance with the present invention.
Figure 8:
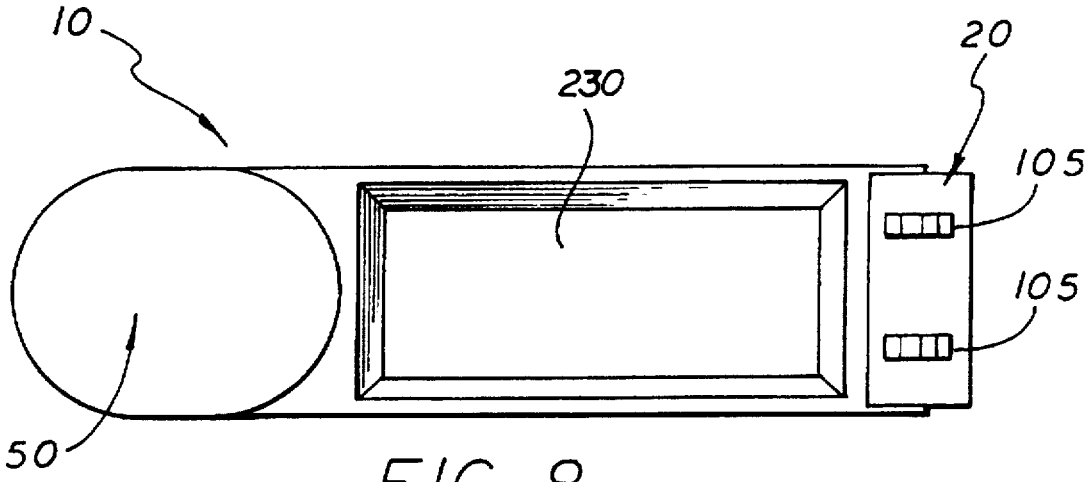
FIG. 8 is a top view of a watercraft in accordance with the present invention.
Figure 9:
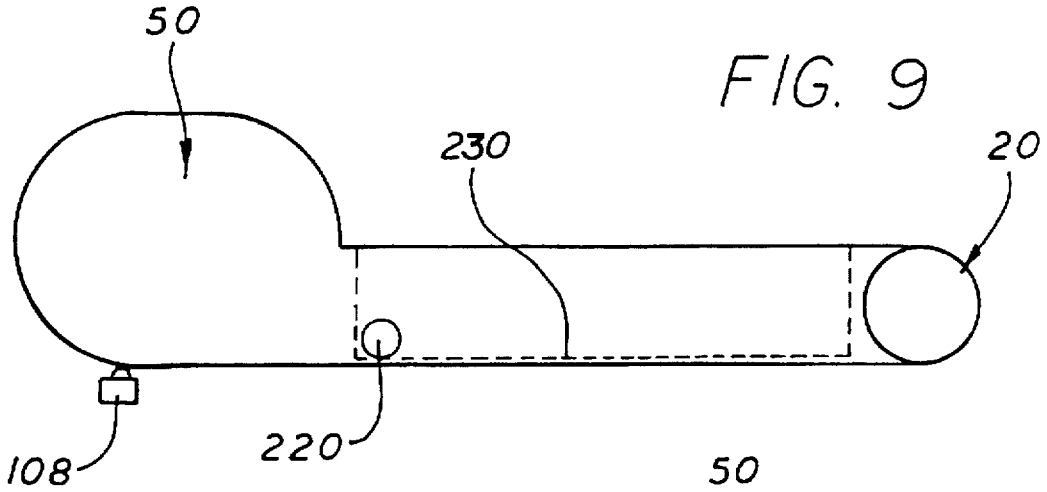
FIG. 9 is a side view of a watercraft in accordance with the present invention.
Figure 10:
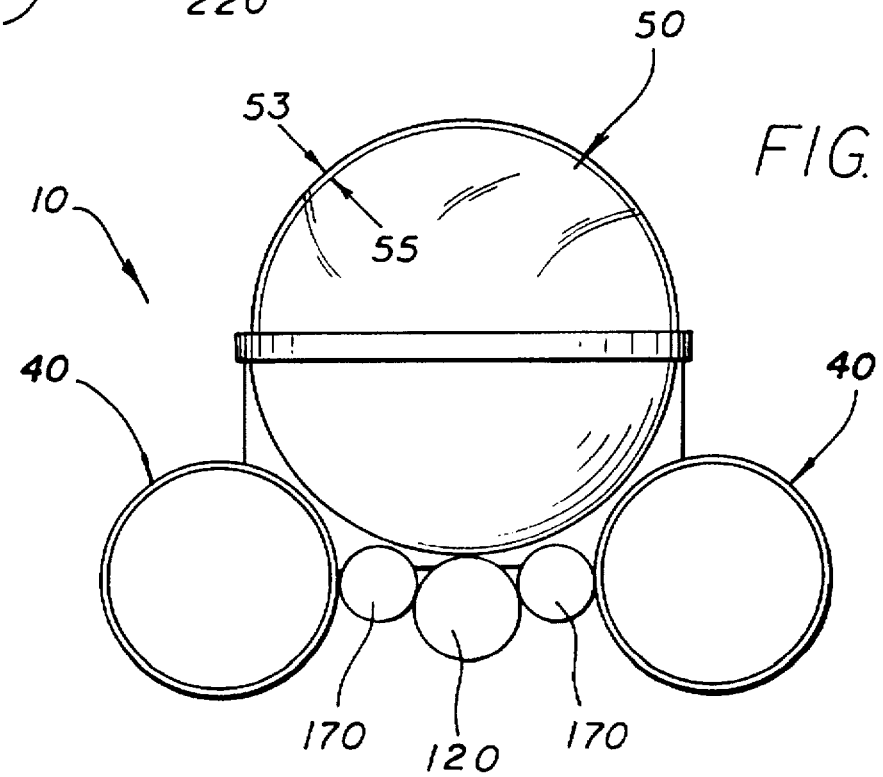
FIG. 10 is a front view of a watercraft in accordance with the present invention.

Any mechanism for mounting the chambers 40 to the watercraft may be used, provided that sufficient mounting strength is provided to retain them to the watercraft while in use. In the embodiment depicted in FIGS. 4–7, the chambers 40 are attached to a support structure 190. Any shaped chambers 40 may be used. For example, in FIG. 4 the chambers 40 have a semi-circular profile; in FIG. 6, the chambers 40 have a tubular tank-like profile.

In one embodiment, air in the chambers 40 are evacuated by using a pumping apparatus 175. Preferably, active pumping of air out of the chambers 40 is not performed.

Additional buoyancy at the surface is provided by a boat section 230. The boat section 230 is provided within the structure 10 of the watercraft. Preferably the boat section 230 is situated between the front buoyancy chamber 50 and tail section 20. Alternatively, it may be provided at any portion of the top of the watercraft structure 10. In the preferred embodiment, the structure defines a boat shell 230 which comprises an indented portion of the structure 10 which is generally open. The boat section 230 displaces water proportional to its volume, when at the surface, providing additional buoyancy. When submerged, it is completely flooded, and therefore does not add to the buoyancy of the watercraft when submerged. This offers an advantage of increased buoyancy and stability at the surface.

In operation, water in the boat section 230 is evacuated as the watercraft surfaces. The water may be evacuated using passive draining, such as through tubes or check valves. Preferably a pump system 220 is provided in order to drain any excess water. One or more pumps may be used at various locations. Preferably, the pump intake is situated at the lowest point of the boat section 230. When submerged, the boat section 230 floods and adds no buoyancy to the watercraft.

In an alternative embodiment, the boat section may be provided with a dummy floor 235, which is above the bottom 240 of the boat section. The space between the dummy floor 235 and bottom 240 may be used for storage or for equipment. Preferably, the dummy floor 235 is perforated so as to allow water to flow into the space between the floor 235 and bottom 240. A hatch (not shown) may be provided so as to enable access to the space between the floor 235 and bottom 240.

The above-described features of the present invention can be combined with each other in any fashion. For example, one embodiment of the invention has a portion of the above-described features. Another embodiment incorporates each of the features together in a single watercraft.

Exemplary embodiments include: an underwater watercraft having positive buoyancy, vertical thruster system and three-point stabilization system; and an underwater watercraft having negative buoyancy and other types of thrusters and stabilization mechanisms, but includes the buoyancy enhancing features, such as boat section 230.

Thus, it is seen that a hybrid boat and underwater watercraft is provided. One skilled in the art will appreciate that the present invention can be practiced by other than the preferred embodiments which are presented for purposes of illustration and not of limitation, and the present invention is limited only by the claims which follow.

What is claimed is:

1. An underwater watercraft having a structure for mounting components, a positive buoyancy when submerged under the surface of a body of water and a center of gravity, the watercraft comprising:

a front end;

a rear end opposite the front end;

a three point stabilization system comprising:

a front buoyancy element having a center of buoyancy and imparting a buoyant force on the watercraft, effectively at a center of buoyancy of the front buoyancy element, wherein the center of buoyancy of the front buoyancy element is between the front end and the center of gravity;

a tail buoyancy element imparting a buoyant force on the watercraft, effectively at the center of buoyancy of the tail buoyancy element, wherein the center of buoyancy of the tail buoyancy element is between the rear end and the center of gravity; and a vertical thruster system wherein the depth of the watercraft below the surface of the water is adjusted using the vertical thruster system.

2. An underwater watercraft having a center of gravity, the watercraft comprising:

a front end;

a rear end opposite the front end;

a three point stabilization system comprising:

a front buoyancy element having a center of buoyancy and imparting a buoyant force on the watercraft, effectively at a center of buoyancy of the front buoyancy element, wherein the center of buoyancy of the front buoyancy element is between the front end and the center of gravity; and a tail buoyancy element imparting a buoyant force on the watercraft, effectively at the center of buoyancy of the tail buoyancy element, wherein the center of buoyancy of the tail buoyancy element is between the rear end and center of gravity.

3. The watercraft of claim 1 wherein the buoyant force imparted by the front buoyancy element exceeds the buoyant force imparted by the tail buoyancy element.

4. The watercraft of claim 1 wherein the front buoyancy element comprises water impermeable structure defining an interior space.

5. The watercraft of claim 1 wherein the front buoyancy element comprises a structure defining an interior space for carrying any of passengers, equipment and cargo.

6. The watercraft of claim 1 wherein the front buoyancy element includes: at least one counterweight; and a structure defining an interior space for carrying any of passengers, equipment and cargo.

7. The watercraft of claim 1 wherein the tail buoyancy element includes: at least one buoyant element; and at least one counterweight.

8. The watercraft of claim 1 wherein the tail buoyancy element includes a movable counterweight.

9. The watercraft of claim 1 wherein the vertical thruster system imparts a vertical thrust having a center of thrust and the center of thrust is between the front and tail buoyancy elements.

10. The watercraft of claim 3 wherein the vertical thruster system includes a single vertical thruster.

11. The watercraft of claim 3 wherein the vertical thruster system includes a plurality of vertical thrusters.

12. The watercraft of claim 1 wherein the vertical thruster system imparts a vertical thrust having a center of thrust and the center of thrust is between the respective centers of buoyancy of the front and tail buoyancy elements.

13. The watercraft of claim 1 wherein the vertical thruster system imparts a vertical thrust at a center of thrust and the center of thrust is situated at the center of gravity.

14. The watercraft of claim 1 wherein the sum buoyant forces of the front and tail buoyancy elements exceeds the weight of the watercraft.

15. The watercraft of claim 1 wherein the watercraft descends to a greater depth when the downward force imparted by the vertical thruster system exceeds the difference between the sum of the buoyant forces imparted by the buoyant elements, including the front buoyancy element and the tail buoyancy element, and the weight of the watercraft.

16. The watercraft of claim 1 wherein the watercraft ascends to a lesser depth when the downward force imparted by the vertical thruster system is less than the difference between the sum of the buoyant forces imparted by the buoyant elements, including the front buoyancy element and the tail buoyancy element, and the weight of the watercraft.

17. The watercraft of claim 1 having a depth limiting means for diminishing the thrust output by the vertical thruster system when the watercraft is at a desired depth below the surface.

18. The watercraft of claim 1 further comprising:

a forward thruster providing thrust optionally in a forward or reverse direction; and a tail thruster for providing thrust to move the tail end left or right.

19. The watercraft of claim I wherein the tail buoyancy element comprises tail shell enclosing a buoyant material.

20. The watercraft of claim 1 further comprising a supplemental buoyancy system wherein the supplemental buoyancy system includes:

at least one supplemental buoyancy chamber for imparting a buoyant force to the watercraft when the weight of the watercraft exceeds the sum of the buoyant forces imparted by the front buoyancy element and the tail buoyancy element; and wherein the buoyant force supplied by the supplemental buoyancy system exceeds the difference between the weight of the watercraft and the sum of the buoyant forces imparted by the front buoyancy element and the tail buoyancy element.

21. The watercraft of claim 20 wherein the supplemental buoyancy system includes: a movable counterweight in the tail buoyancy element.

22. An underwater watercraft having a positive buoyancy when submerged under the surface of a body of water and having a center of gravity, the watercraft comprising:

a front end;

a rear end opposite the front end;

a plurality of buoyancy imparting elements; and a vertical thruster wherein the depth of the watercraft below the surface of the water is adjusted using the vertical thruster;

wherein the plurality of buoyancy imparting elements include:

a front buoyancy element having a center of buoyancy and imparting a buoyant force on the watercraft, effectively at a center of buoyancy of the front buoyancy element, wherein the center of buoyancy of the front buoyancy element is between the front end and the center of gravity; and a tail buoyancy element imparting a buoyant force on the watercraft, effectively at the center of buoyancy of the tail buoyancy element, wherein the center of buoyancy of the tail buoyancy element is between the rear end and the center of gravity.

23. The watercraft of claim 22 having a boat mode of operation wherein the watercraft is floatable on a surface of a body of water, and an underwater mode of operation wherein the watercraft is submergible below the surface of the body of water, the watercraft further comprising a boat section between the front end and the rear end, the boat section including an air permeable top, side walls and a bottom surface wherein the top of the boat section can emerge above the surface of the water when the watercraft is in boat mode.

24. An underwater watercraft having a structure for mounting components, the watercraft having a boat mode of operation wherein the watercraft is floatable on a surface of a body of water and an underwater mode of operation wherein the watercraft is submergible below the surface of the body of water, the watercraft comprising:

a surface-buoyancy supplementing system including:

a boat section defined in the structure, wherein the boat section includes air permeable top, side walls and a bottom surface wherein the top of the boat section can emerge above the surface of the water when the watercraft is in boat mode; and draining means for draining water from the boat section when the top of the boat section is above the surface of the water;

a front end;

a rear end opposite the front end; and a three point stabilization system including:

a front buoyancy element having a center of buoyancy and imparting a buoyant force on the watercraft, effectively at a center of buoyancy of the front buoyancy element, wherein the center of buoyancy of the front buoyancy element is between the front end and center of gravity; and a tail buoyancy element imparting a buoyant force on the watercraft, effectively at the center of buoyancy of the tail buoyancy element, wherein the center of buoyancy of the tail buoyancy element is between the rear end and the center of gravity.

25. The watercraft of claim 24 further comprising a supplemental buoyancy system wherein the supplemental buoyancy system includes:

at least one supplemental buoyancy chamber for imparting a buoyant force to the watercraft when the weight of the watercraft exceeds the sum of the buoyant forces imparted by the front buoyancy element and the tail buoyancy element; and wherein the buoyant force supplied by the supplemental buoyancy system exceeds the difference between the weight of the watercraft and the sum of the buoyant forces imparted by the front buoyancy element and the tail buoyancy element.

26. The watercraft of claim 24 wherein the watercraft has a positive buoyancy when submerged under the surface of a body of water, the watercraft comprising:

a vertical thruster wherein the depth of the watercraft below the surface of the water is adjustable using the vertical thruster; and the vertical thruster system is mounted on the structure between the center of buoyancy of the front buoyancy element and the rear buoyancy element.

27. An underwater watercraft having a center of gravity, and having:

a boat mode of operation wherein the watercraft is floatable on a surface of a body of water; and an underwater mode of operation wherein the watercraft is submergible below the surface of the body of water; and wherein the watercraft comprises:

a structure for mounting components, wherein the structure includes:

a boat section including an air permeable top, side walls and a bottom surface wherein the top of the boat section can emerge above the surface of the water when the watercraft is in boat mode, a front end;

a rear end opposite the front end;

a three point stabilization system comprising:

a front buoyancy element having a center of buoyancy and imparting a buoyant force on the watercraft, effectively at a center of buoyancy of the front buoyancy element, wherein the center of buoyancy of the front buoyancy element is between the front end and the center of gravity; and a rear buoyancy element imparting a buoyant force on the watercraft, effectively at the center of buoyancy of the rear buoyancy element, wherein the center of buoyancy of the rear buoyancy element is between the rear end and the center of gravity.

* * * * *